US005987782A

United States Patent [19]

Bramani

[11] Patent Number: 5,987,782

[45] Date of Patent: Nov. 23, 1999

[54] REINFORCED HIGH-TRACTION SOLE UNIT

[75] Inventor: Marco Bramani, Milan, Italy

[73] Assignee: Vibram S.p.A., Albizzate, Italy

[21] Appl. No.: 09/020,845

[22] Filed: Feb. 9, 1998

[30] Foreign Application Priority Data

Feb. 7, 1997 [IT] Italy ..... MI97A0254

[51] Int. Cl.[6] ..... A43B 23/00; A43B 13/14

[52] U.S. Cl. ..... 36/107; 36/31

[58] Field of Search ..... 36/107, 113, 25 R, 36/30 R, 32 R, 31, 33

[56] References Cited

U.S. PATENT DOCUMENTS

| | | | |
|---|---|---|---|
| 2,383,122 | 8/1945 | Ghez et al. | 36/32 R |
| 2,557,946 | 6/1951 | Crooker | 36/32 R |
| 4,130,947 | 12/1978 | Denu | 36/30 R |
| 4,364,190 | 12/1982 | Yonkers | 36/32 R |
| 4,561,195 | 12/1985 | Onoda et al. | 36/30 R |
| 4,753,021 | 6/1988 | Cohen | 36/25 R X |
| 4,785,557 | 11/1988 | Kelley et al. | 36/30 R X |
| 5,255,451 | 10/1993 | Tong et al. | 36/30 A |
| 5,720,118 | 2/1998 | Mayer et al. | 36/107 |

FOREIGN PATENT DOCUMENTS

| | | |
|---|---|---|
| 0 373 330 | 6/1990 | European Pat. Off. . |
| 0 434 076 | 6/1991 | European Pat. Off. . |
| 91 10 849 | 2/1992 | Germany . |

*Primary Examiner*—B. Dayoan

*Attorney, Agent, or Firm*—Jacobson, Price, Holman & Stern, PLLC

[57] ABSTRACT

A high-traction sole unit, including a rubber tread and a series of more or less rigid lattice inserts, which are separated among them by cavities and each of them is composed of undulated elements and a series of inverted T-shaped transverse ribs, the axes of which are perpendicular, at the points of relative intersection, to an S-shaped curved line extending from the heel to the toe of the sole unit; the lattice inserts are joined together by rubber or elastomeric elements, which are constituted by the same material that constitutes the tread or the wedge of the footwear. To usefully lighten the structure, further ribs of rubber are provided, differing from each other in shape and dimensions, which are suitably located within concavities in the inserts; finally the lattice inserts can be constructed of different materials, such as carbon fiber or fiber-filled plastic material or metal materials.

20 Claims, 3 Drawing Sheets

16
13
161
151
15
E
D
C
B
A
152
153
III

REINFORCED HIGH-TRACTION SOLE UNIT

BACKGROUND OF THE INVENTION

Field of the Invention

This invention relates to a high-traction sole unit. Sole units of various forms are known which, at various times and by differing arrangements have sought to improve foot comfort or protection for the foot of the shoe user.

For example, for walking shoes it has been sought to insert elements of greater or lesser softness into the sole unit and into the shoe to improve comfort.

In other cases, for example of anti-accident shoes, protection elements have been inserted to protect the foot by surrounding it.

Alternatively, such protection devices are positioned above the foot to protect it from heavy objects or, generally, from crushing.

Particularly in the case of mountain or sports footwear there is a requirement for achieving considerable traction accompanied by good sensitivity and stability on the ground, followed by good absorption of impact force during the step.

SUMMARY OF THE INVENTION

In view of this, an object of the invention is to provide a high-traction sole unit, in particular for mountain or sports footwear, which facilitates correct bearing of the foot and prevents poor and incorrect walking.

A further object is to provide a sole unit which prevents foot fatigue, particularly during lengthy stressing, by controlling its torsion during movement and improving the footwear grip on slopes and/or rough ground, compared with the known art.

A further object of the present invention is to provide a sole unit of differential reaction, the support effect of which is suitably varied in the various sole portion regions with reference to bearing, braking and thrust forces.

These and further objects are attained, according to the present invention, by a high-traction sole unit, in particular for mountain or sports footwear.

Advantageously, to better analyse the foot geometry, its point of articulation and its movement during mountain walking, a study was made of the parameters relative to the angles of incidence which have to be taken into consideration in designing the sole unit, together with the geometry of the rolling axis resulting in identification of the minimum characteristics of a possible mix.

A series of lattice inserts are positioned within the sole unit as close as possible to the ground, so as to reduce to a minimum the elastic element interposed between the part connected to the vamp and the bearing surface, using the tread essentially as an antislip element and giving the inserts the task of controlling the elasticity of the system.

The insertion of elastic elements (rubber, plastic materials, thermoplastic materials with fibre filler) into the interior of the sole unit is of fundamental importance, as is also important that they be of different shape and size.

Preferably, the inserts are constructed by rigid material (a lamina) and each of them is composed of a series of transverse inverted-T ribs having their axis perpendicular to an S-shaped dorsal line ideally representing the rolling axis.

The axes are equidistant along the dorsal line, but because of their different inclination are at different distances apart along the outer edge of the insert. Their profile is therefore different on the outer and inner sides of the sole unit.

The inverted-T ribs provide the necessary transverse rigidity to the sole portion.

Rotation of the T-elements is guaranteed by rubber elements, which are rigidified by suitable rubber ribs for lightening the structure, these being positioned in the concavities of the inserts having different sizes and shapes, according to their location.

Hence, advantageously, in contrast with simple one-piece inserts co-moulded in the rubber, which can provide a single transverse or torsional rigidifying effect, with a high-traction sole unit, according to the invention, a differential system reaction is achieved, given by the combination of the rigidity of the inserts and the elasticity of the suitably shaped and positioned rubber, to consequently obtain a better foot torsion and foot flexion control and a reduction in walking fatigue.

BRIEF DESCRIPTION OF THE DRAWINGS

The characteristics and advantages of a biomechanical sole unit according to the present invention will be more apparent from the description given hereinafter by way of non-limiting example, with reference to the accompanying schematic drawings, on which.

DETAILED DESCRIPTION OF THE PREFERRED EMBODIMENTS

Figures 1, 2, 3:
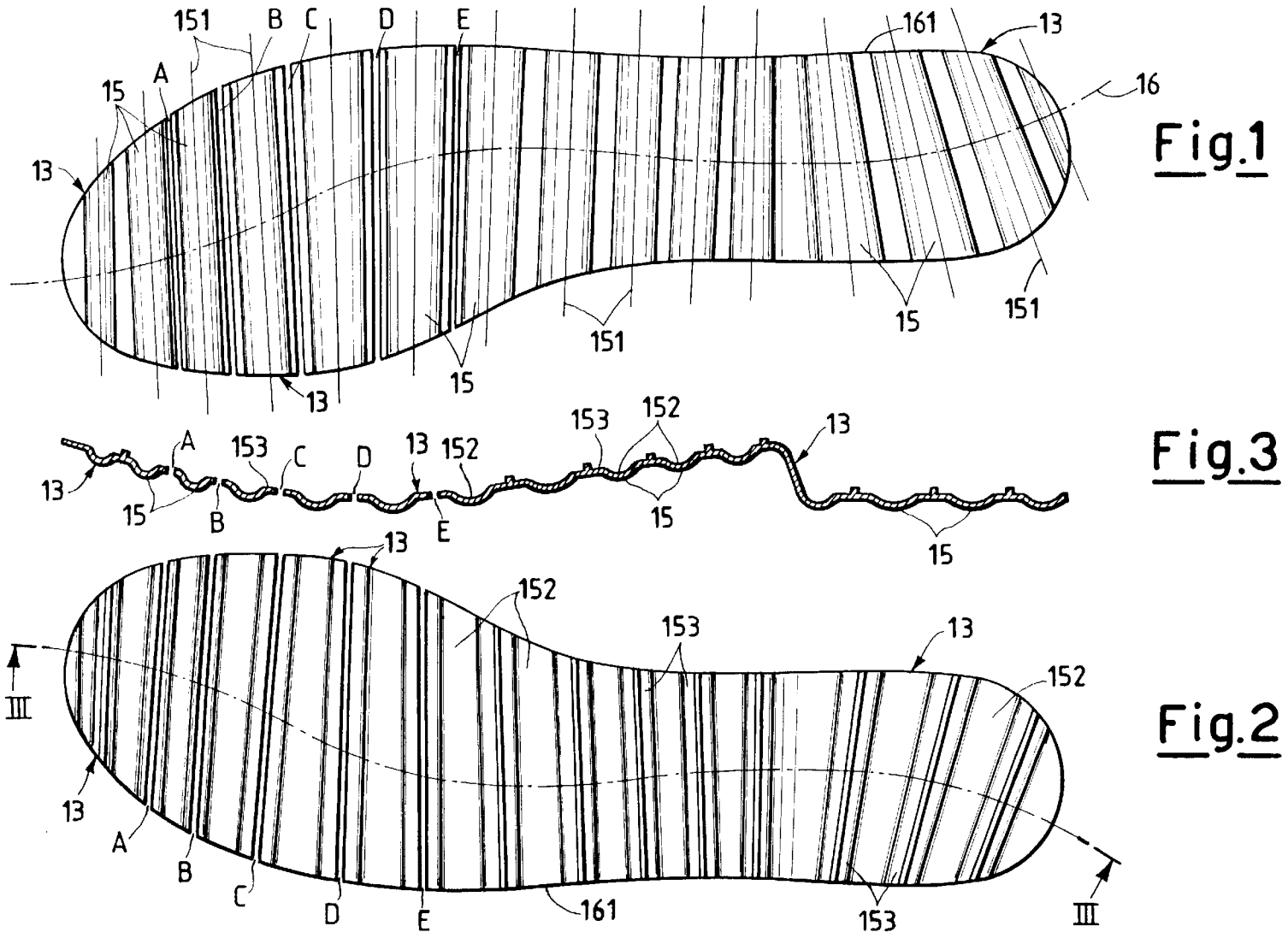
FIG. 1 is a plan view from above of a series of lattice inserts positioned within a sole unit, according to the present invention.
FIG. 2 is a plan view from below of the lattice inserts of FIG. 1.
FIG. 3 is a section on the line III—III of FIG. 2.
Figure 4:
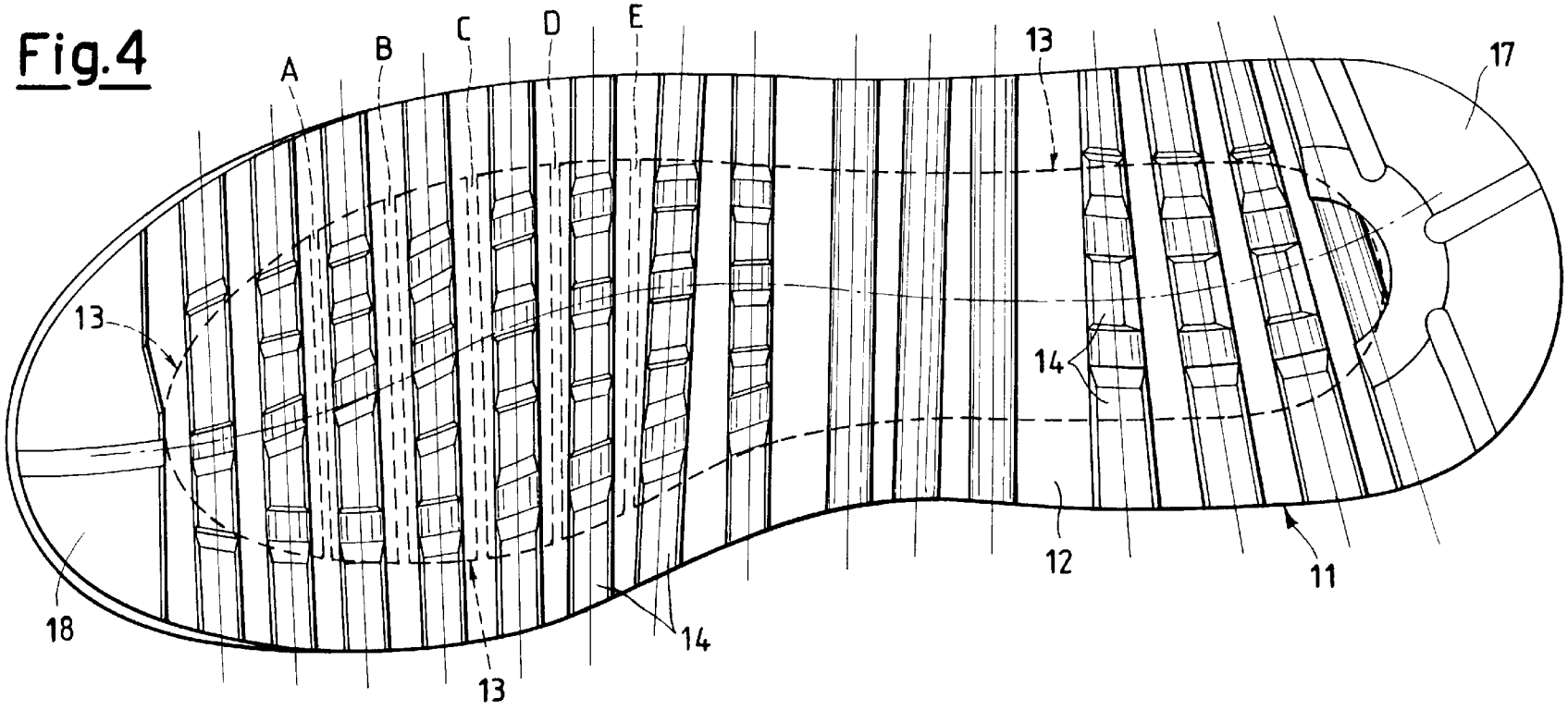
FIG. 4 is a plan view of a high-traction sole unit according to the present invention, showing the particular arrangement of the lattice inserts positioned within it.
Figure 5:
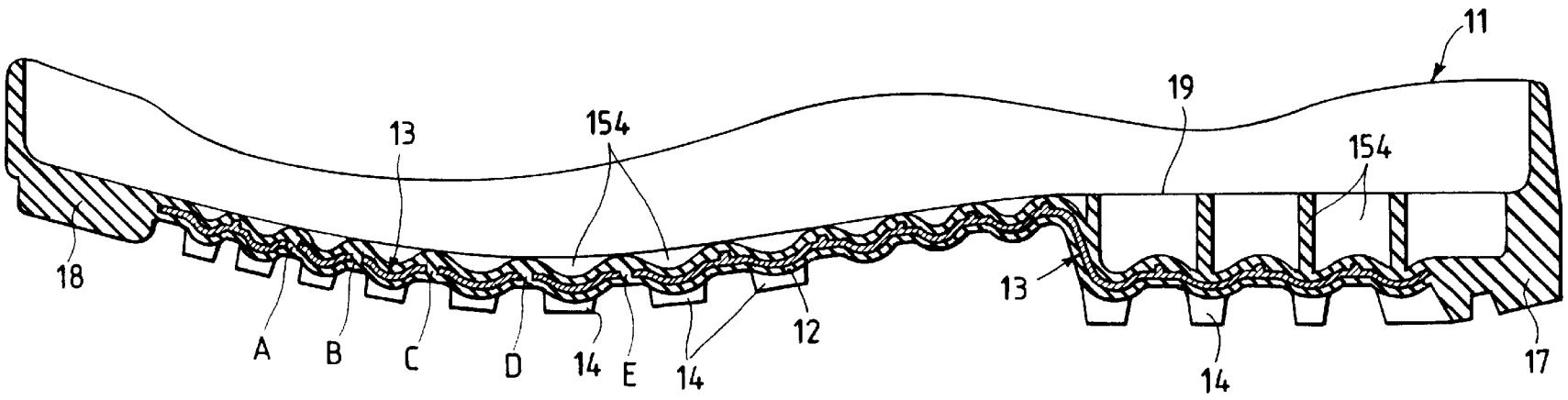
FIG. 5 is a partly sectional view of footwear comprising a sole unit according to the present invention, better showing schematically the particular arrangement of the lattice inserts positioned within it.

With reference to the said figures, a sole unit, constructed in accordance with the present invention, is indicated overall by 11. The sole unit 11 comprises essentially a tread 12 and a series of relatively rigid lattice inserts 13.

In this way, the sole unit 11 comprises an inlay, which is separated in several parts or inserts 13 by means of cavities A, B, C, D, E.

The possible distance between each single insert 13 can be about 1 mm, while the thickness of the inserts can be varied along the transversal profile (such embodiment is not shown in figures).

In a preferred but non-limiting embodiment, each insert 13 consists of an element in the form of a lamina, having a semicircular outline.

The inserts 13 follow respective undulate outlines, which are arranged transversely to an imaginary axis of the sole unit 11 which extends longitudinally from the heel 17 to the toe 18.

Further the inserts 13 are joined together by rubber or elastomeric elements, which are constituted by the same material that constitutes the tread 12 and the wedge of the footwear.

The tread 12 can be patterned as variously shaped projecting studs 14 faceted with sharp edges to facilitate the hold on steep and/or uneven ground.

In any event, the pattern of the tread 12 is extremely simple and functional and is conceived as integration of the stiffening inserts 13, paying particular attention to the type of bearing surface.

In this respect, having reduced the thickness of the rubber present below the inserts 13 to a minimum, a mix must be made up of very low abrasion and high elasticity, so that the said rubber operates within the sole unit 11 as an elastic element.

The lattice inserts 13 can be formed of different materials, such as carbon fibre, plastic material, or fibre-filled thermoplastic material, and are composed of a series of inverted T-shaped transverse ribs 15 the axis of which, indicated by 151, is perpendicular at the hypothetical intersection points to an S-shaped curved line, indicated by 16, similar to a backbone, positioned longitudinally to the sole unit 11 starting from the heel 17 and terminating at the toe 18. The curved line 16 represents ideally the rolling axis of the foot, the profile deriving from it following the natural region of flexure of the foot during walking.

In a non-limiting embodiment of the invention, within the heel 17 the inserts 13 can be positioned at a height slightly greater than the sole portion 19, so as to increase the height of the studs 14 of the heel 17.

The axes 151 of the ribs 15 are equidistant along the curved line 16, and because of their different inclination are at different distances along the outer edges 161 of the inserts 13. The profiles of the inserts 13 are therefore different on the outer side and inner side of the sole unit 11.

The inserts 13 and the ribs 15 are connected together on the upper side by a semicircular concave hinge element 152 which joins together the bases 153 of the T. The purpose of this hinge element 152 is to control the inserts 13 and the ribs 15 to rotate, its diameter depending on the height of the studs 14, such as to reduce to a minimum the thickness of the tread 12 and to eliminate to a maximum extent the elastic element interposed between the ground and said supporting inserts 13.

Transverse rigidity of the sole portion 19 is provided by the transverse ribs 15, which constitute the inserts 13.

Rotation of the hinge element 152 is stiffened by inserting suitable rubber lightening ribs of different width and shape according to their location, they being indicated by 154 and positioned in concavities within the inserts 13.

Hence, depending on their shape and their thickness, the combination of the rigid and elastic elements increases or decreases the supporting effect of the sole unit 11 in the various bearing, braking or thrusting regions (differential reaction).

The geometry of the undulated inserts 13, the dimensions of the various elements (inverted-T ribs 15, concave elements 152, bases 153, lightening ribs 154), the heights of the crests of each undulation from a horizontal plane and the type of material used for constructing the inserts 13 can vary on the basis of the type of target footwear and have been obtained from laboratory studies supported by mechanical and physical tests.

The nature and type of material of the inserts 13 are therefore directly related to final characteristics required by the user and depend on the torsional ridigity between the heel 17 and sole portion 19, the lateral flexing moment, the weight, the slip resistance, and the abrasion of the tread 12.

With particular reference to FIG. 3, the schematic geometrical profile of the inserts 13 and their allocation are obtained empirically after a careful biomechanical and engineering examination of the technical characteristics required of a high-traction sole unit, in particular for mountain or sports footwear, namely relative flexibility in the longitudinal direction, good stability and rigidity in the middle-side region, substantial lightness, comfort, high traction and considerable absorption of the forces of impact with the ground.

In this respect, a sole unit 11 of this type must be able to withstand natural flexure forces which occur especially in the front region of the foot (metatarsus and phalanx joints). This characteristic is particularly important during ascent walking.

Moreover, to always maintain the footwear and foot in stable positions, in particular during scrambling up uneven paths or up rocks, the sole unit 11 must present substantial rigidity along the lateral regions in correspondence with the central line of the foot, because in this case only small or narrow parts of these regions are in contact with the ground, these hence being the most stressed.

It is also apparent that the weight of the footwear considerably influences user performance, in the sense that the greater the weight of the sole unit 11 the greater is the energy expended during the walk.

Finally a further important characteristic required of the sole unit 11 for mountain footwear is comfort for the user, in that such footwear is worn only for a few hours. Again in this case, special physical characteristics of the sole unit 11, such as reinforcements positioned in regions involving localized biomechanical forces and/or pressures, contribute towards improving the wearability and comfort of the footwear compared with traditional sole units.

The presence of the inserts 13 stiffens the middle and lateral regions of the sole unit 11 and, on the other hand, does not alter the longitudinal flexibility. However, this effect can be controlled by the rubber ribs 15, by suitably varying the thickness and their allocation or their radius.

The studs 14 of the tread 12 can be positioned in correspondence with the undulations of the inserts 13 and arranged essentially to follow the pattern of the ribs 15. Preferably, said studs 14 are arranged on the lower side of the undulations.

In preferred embodiments of the present invention, the top part of the profile of the inserts 13, between one transverse row of studs 14 and the next in the direction of the ribs 15, forms channel portions which facilitate lateral expulsion of mud and snow. In the heel 17, this part can form the framework of the studs 14 and enable the sole unit 11 to grip the ground with a hook effect.

It has thus been shown that by inserting relatively rigid undulated inserts 13 into the sole unit 11, an increase in load stability is achieved so increasing step stability during walking, particularly in climbing and on precipitous and uneven slopes. In addition, it reduces the concentration of localized loads, which can occur for example during walking on rock when the foot comes into contact with sharp projections or the like, so that the foot does not feel these projections.

Controls of the sole unit 11 flexion and torsion also considerably improve the grip of the tread 12 on the ground.

Consequently greater step stability and safety is achieved.

The resistance to lateral flexure provided by the sole unit 11 according to the present invention also aids the sensitivity of the foot in recognizing an unbalanced movement and opposing it, whereas the considerable transverse rigidity created by the large number and geometry of the inserts 13 increases the facility for edgewise walking on slopes.

With regard to the wedge or top of the footwear, this can be constructed of moulded rubber simultaneously with the tread 12.

Alternatively, it can be formed of low-density closed or open cell expanded material, also moulded simultaneously with the tread 12.

Again, this part of the footwear can be moulded separately from the tread 12 and at a different time. In this case it is glued later to the tread 12.

The constituent material of the wedge, besides supporting the footwear vamp, improves damping and absorption of impact forces during walking.

The undulated lattice inserts 13 are moulded either previously or during the moulding of the rubber, depending on the type of material used.

Finally, it should be noted that the mould by which the sole unit 11 is obtained, according to the present invention, is a mould analogous to those moulds normally used for moulding rubber sole units 11.

The characteristics of the high-traction sole unit, in particular for mountain or sports footwear, according to the present invention, are clear from the description, as are its resultant advantages.

Specifically, these include:

better lateral stability, compared with traditional sole units, during walking on uneven slopes or rock;

better load distribution on the sole portion;

good torsional rigidity and high traction at the foot articulation points during the movements required for effecting a step;

high flexibility in the metatarsus region and the phalanx region of the foot toes;

considerable damping of loads on the sole portion and relative absorption of impact forces on the sole unit at the moment in which ground contact occurs;

substantial footwear lightness;

adequate user comfort.

Finally, it is apparent that numerous further modifications can be made to the high-traction sole unit of the present invention without leaving the novel principles of the inventive idea, it also being apparent that in the practical implementation of the invention the materials, forms and dimensions of the illustrated details can be chosen according to requirements, and can be replaced by others technically equivalent.

The Italian priority application No. MI97A 000254 is herein incorporated by reference.

What is claimed is:

1. A high-traction sole unit comprising a rubber tread and at least one relatively rigid lattice insert situated in an interior of said tread and consisting of at least one lamina element comprising a series of successive undulations, said undulations being arranged transverse to at least one axis extending from at least one heel portion to at least one toe portion, said sole unit comprises a plurality of independent, separated lattice inserts, which are separated by cavities, said plurality of separated inserts consisting of a plurality of said lamina elements.

2. A sole unit as claimed in claim 1, wherein said undulations of said lamina elements, which constitute said inserts comprise a series of crests having variously inclined transverse ribs.

3. A sole unit as claimed in claim 2, wherein axes of said transverse ribs are perpendicular, at the points of relative intersection, to an S-shaped curved line, positioned longitudinally to said sole unit.

4. A sole unit as claimed in claim 1, wherein said inserts are joined together by a rubber elastomeric element.

5. A sole unit as claimed in claim 2, wherein, when said lattice inserts are viewed sideways, said transverse ribs of said inserts are of inverted-T shape.

6. A sole unit as claimed in claim 3, wherein axes of the ribs are equidistant along said curved line, whereas they are at different distances apart along an outer edge of said inserts, so that a geometrical profile of said inserts has a semicircular outline and different from outer and inner sides of said sole unit.

7. A sole unit as claimed in claim 2, wherein said transverse ribs are connected together by at least one concave semicircular hinge element which joins together bases of inverted-T portions in pairs.

8. A sole unit as claimed in claim 2, wherein studs are positioned in correspondence with said undulations of the lattice insert.

9. A sole unit as claimed in claim 8, wherein said studs are positioned substantially to follow a path of said ribs and their axes.

10. A sole unit as claimed in claim 8, wherein said studs are positioned in correspondence with a bottom of said undulations of the lattice insert.

11. A sole unit as claimed in claim 8, wherein, in correspondence with said heel portion, said lattice inserts are positioned at a height greater than that in correspondence with a sole portion, so enabling those studs positioned below the heel portion to have a greater height than those positioned below said sole portion.

12. A sole unit as claimed in claim 7, wherein a diameter of said hinge element is related to a height of said studs.

13. A sole unit as claimed in claim 1, wherein said lattice inserts are positioned as close as possible to the ground.

14. A sole unit as claimed in claim 1, wherein said lattice inserts are separated, one from the other, by a distance of about 1 mm.

15. A sole unit as claimed in claim 1, wherein said lattice inserts have a non-uniform thickness, said thickness varying along a transversal profile with respect to said sole unit.

16. A sole unit as claimed in claim 2, wherein rubber ribs are provided in correspondence with concavities in said lattice inserts, and at a same time to control the rotation of said transverse ribs, each of said concavities being situated between two successive crests of the undulations of said inserts.

17. A sole unit as claimed in claim 15, wherein said rubber ribs are different, depending on a location in the lattice inserts.

18. A sole unit as claimed in claim 1, wherein said lattice inserts are constructed of one of plastic and thermoplastic material.

19. A sole unit as claimed in claim 18, wherein said inserts of plastic material have a composition containing one of reinforcing glass fibre and carbon fibre fillers.

20. A sole unit as claimed in claim 1, further comprising, above said tread and inserts, an upper portion formed of rubber moulded simultaneously with said tread.

* * * * *